United States Patent [19]

Simpson

[11] Patent Number: 4,813,097

[45] Date of Patent: Mar. 21, 1989

[54] SCRAPING DEVICE FOR REMOVING DEPOSITS FROM FLUES, CHIMNEYS, AND THE LIKE

[76] Inventor: Raymond A. Simpson, 75 Valley Road, Kawerau, New Zealand

[21] Appl. No.: 122,910

[22] Filed: Nov. 19, 1987

[30] Foreign Application Priority Data

Nov. 20, 1986 [NZ] New Zealand ..... 218348

[51] Int. Cl.[4] ..... F23J 3/02

[52] U.S. Cl. ..... 15/242; 15/104.16; 126/16

[58] Field of Search ..... 15/242, 243, 249, 104.16, 15/104.31, 162, 163; 126/16

[56] References Cited

U.S. PATENT DOCUMENTS

| | | | |
|---|---|---|---|
| 175,628 | 4/1876 | Schulte | 15/104.16 |
| 509,237 | 11/1893 | Olsen et al. | 15/104.16 X |
| 731,190 | 6/1903 | Kuhlman | 15/242 |
| 1,185,688 | 6/1916 | LaMarsh | 15/104.16 |
| 2,157,493 | 5/1939 | Miller et al. | 15/243 X |
| 3,790,983 | 2/1974 | Whitsett | 15/242 X |
| 4,113,611 | 9/1978 | Gohm | 126/16 X |
| 4,625,358 | 12/1986 | Barrett | 15/242 |

FOREIGN PATENT DOCUMENTS

| | | | |
|---|---|---|---|
| 2034431 | 6/1980 | United Kingdom | 15/104.16 |

*Primary Examiner*—Harvey C. Hornsby
*Assistant Examiner*—Stephen F. Gerrity
*Attorney, Agent, or Firm*—Abelman Frayne Rezac & Schwab

[57] ABSTRACT

The invention essentially comprises a scraping device for mounting at the end of a rod, having a body comprising a plurality of radial extending arms. At the ends of each arm is the scraping surface. The construction of this scraping device is such that when the device is positioned in a flue or like structure, debris and incrustations can be scraped therefrom by a reciprocal movement of the scraping device against the surface to be cleaned.

6 Claims, 2 Drawing Sheets

SCRAPING DEVICE FOR REMOVING DEPOSITS FROM FLUES, CHIMNEYS, AND THE LIKE

BACKGROUND OF THE INVENTION

This invention relates to scraping devices. The present invention seeks to provide a scraping device suitable for attachment to a rod (or a plurality of interconnected rods) for cleaning flues, chimneys and the like in the same manner as a conventional chimney brush. It is anticipated that the present invention will be particularly suited to removing encrusted deposits from the lining of tubular metal wood stove flues.

Further objects and advantages of the present invention will become apparent from the ensuing description which is given by way of example.

SUMMARY OF THE INVENTION

According to the present invention there is provided a scraping device for mounting at the end of a rod, said device having a body comprising a plurality of radially extending arms of substantially equal length, wherein each arm has a scraping surface at the distal end thereof, the arrangement and disposition of the scraping surface being such that when the scraping device is positioned inside a flue or like structure so that the scraping surface makes contact with the surface to be cleaned, debris and incrustations can be scraped therefrom by reciprocal movement of the scraping device against the surface to be cleaned.

According to further aspect of the present invention the arms may be made of a resilient material.

According to yet another aspect of the present invention the body may be made up of two substantially Y-shaped body sections fixed one above the other such that the arms are evenly spread apart.

According to a still further aspect of the present invention the scraping of the surface may be provided by a scraper which defines at least one scraping surface and which is swivel mounted at the distal end of each arm, the arrangement being such that the scrapers may be rotated as they become worn so as to present a new scraping surface to the work face.

Aspects of the present invention will now be described by way of example only with reference to the accompanying drawings in which:

DETAILED DESCRIPTION OF THE PREFERRED EMBODIMENT

Figure 1:
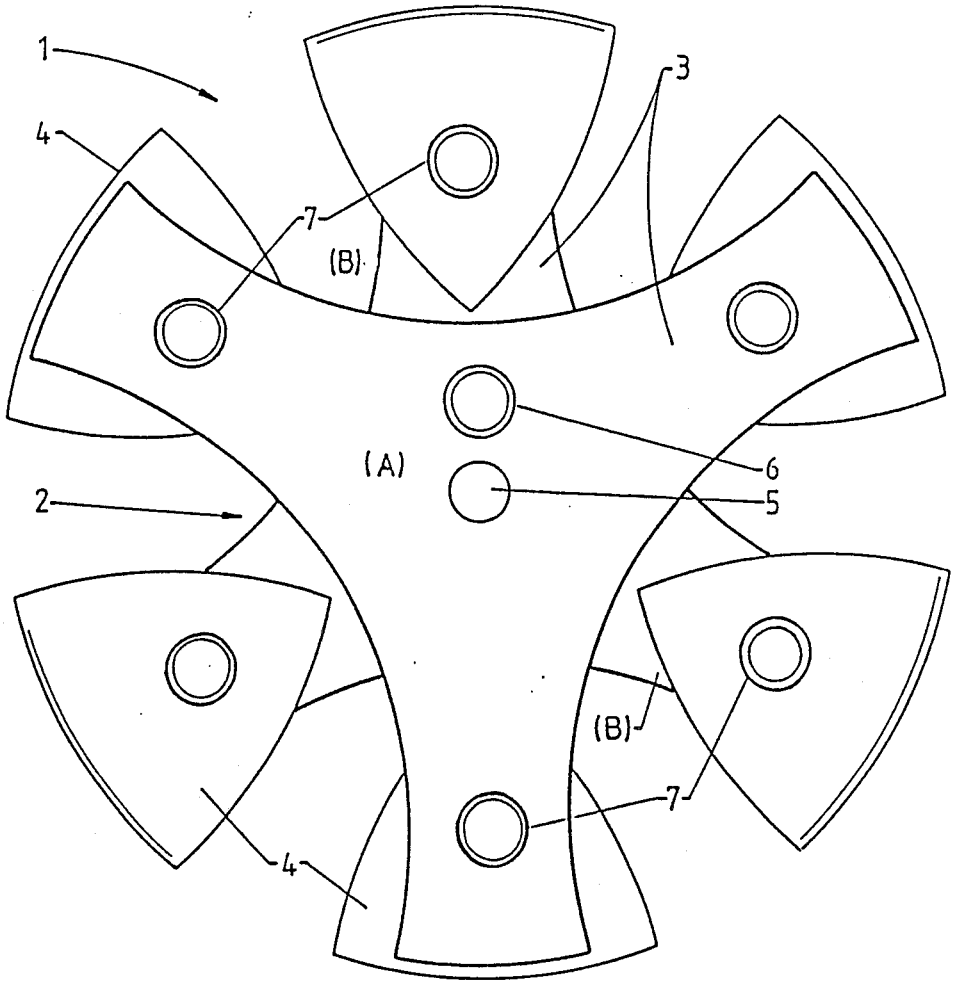
FIG. 1: is a top perspective view of a scraping device (minus a rod to which it could be attached) in accordance with one possible embodiment of the present invention.

With reference to the drawings and by way of example only, a scraping device generally indicated by arrow 1 for mounting on a rod (not shown), has a body generally indicated by arrow 2 which comprises a plurality of radial extending arms 3 of substantially equal length. Each arm 3 has a scraping surface 4 at the distal end thereof. The arrangement and disposition of the aforesaid parts are such that when the scraping device 1 is positioned inside a flue or like structure so that the scraping surface makes contact with the surface to be cleaned, debris and incrustations can be scraped therefrom by reciprocal movement of the scraping device against the surface to be cleaned.

With reference to FIG. 1, the body 2 is made up of two substantially Y-shaped body sections, said sections designated (A) and (B), fixed one above the other such that the arms are evenly spread apart. In this embodiment a total of six arms are shown, but it should be appreciated that any number of arms will suffice. The arms are spaced such that the three arms of the first body section (A) are on a closely parallel plane with the three arms of the second body section (B).

The body sections (A) and (B) are preferably made from a resilient material. A plastics material such as "Teflon" (TTM) or ultra high molecular weight polyethylene (UHMWPE) would be suitable. An advantage of the arms 3 being of a resilient material is that they more readily conform to the inside surface of the flue pipe to be cleaned, and are able to pass over obstacles which may be encountered inside the flue such as rivets and joints.

The body sections (A) and (B) are co-axially mounted to the end of a rod (not shown). A variety of methods of mounting the body to the rod are envisaged and these may include the rod being mounted to the body by means of a threaded spigot integrally formed with the end of the rod and located in an aperture 5 located at the centre of said body and held in place by means of a nut. Alternatively, the rod may be mounted to the body by means of a bolt adapted to be threaded into the bottom of said rod.

A rivet 6 or other fixing means may fix body sections (A) and (B) in position relative to one amother.

With further reference to FIG. 1 the scraping surface may be provided by a scraper 4 which defines at least one scraping surface and which is swivel mounted at the distal end of each arm, the arrangement being such that the scrapers may be rotated as they become worn so as to present a new scraping surface to the work face. In use, when cleaning a flue or like structure, each scraper will retain its position until taken out of the flue and manually turned to present a new scraping surface to the work face.

In this embodiment the scrapers 4 are substantially triangular in shape with the three sides providing outwardly arcuate contact surfaces, the arrangement being such that the edge of each contact surface of the scraper lies one the circumferential line of a circle. The rake of the scraping surfaces one one body section may be opposite to that on the other body section.

The scrapers 4 may be fixed to the distal ends of the arms 3 by means of rivets 7. Where a single rivet is used the scraper is effectively swivel mounted.

Alternative methods of mounting the scrapers 4 are envisaged, so that the position of the scraping surface is adjustable in relation to the arms. This is one possible way that the scraping device can be adapted to the internal geometries of flues or like structures, however it is to be appreciated that other configurations are possible for the body, arms and scraping surfaces.

The scraping device may have arms comprising a radial slot extending towards a distal end thereof, through said slot the scrapers are bolted. Alternatively, to enable the scraping device to be used in flues of differing dimensions, the scrapers could be eccentrically swivel mounted on the arms.

The scrapers 4 may be made out of the same resilient material as the arms, or alternatively they may be made out of metal. The scrapers could pehaps even comprise steel washers.

If the scrapers are made out of a sheet material such as "Teflon" or UHMWPE it will be found that the shape of the body sections (A), (B) and the shape of the scrapers will result in minimal waste in the sheet out of which the scrapers and body sections are cut.

Figure 2:
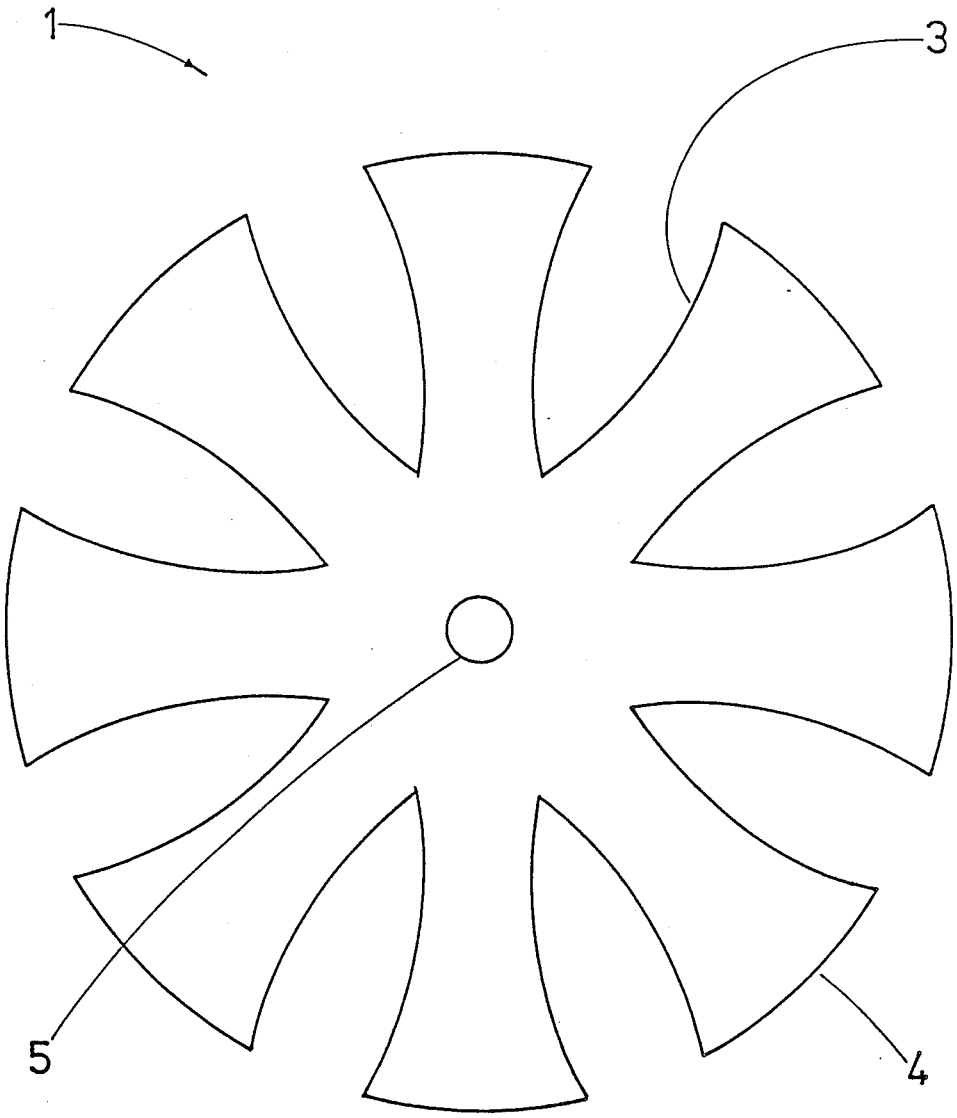
FIG. 2: is a diagrammatic plan view of another possible embodiment.

In another embodiment it is envisaged that the body and arms may be integrally formed as in FIG. 2. The arms are curved in a manner such that stress caused by the scraping motion is substantially spread evenly across the body of said scraping device. In the embodiment shown the scraping surface is integrally formed with the arms, thus avoiding the need for riveting the scraping surface as described in the previous embodiment.

A further embodiment is envisaged whereby there are a plurality of bodies the arrangement of such being that the scraping device provides a continuous peripheral outline.

Aspects of the present invention have being described by way of example only and it will be appreciated that modifications and additions thereto may be made without departing from the spirit or scope thereof as defined in the appended claims.

I claim:

1. A scraping device for mounting on the end of a rod, comprising:

a spoke-shaped array of radially extending arms of substantially equal length interconnected with each other at a central hub of the device;

a substantially planar scraper defining at least two scraping surface mounted on each said arm for rotational movement about an axis extending perpendicular to the free end of the associated arm; and, means of mounting said scrapers on said arms for said rotational movement;

said scrapers being selectively rotated as they become worn to present a new scraping surface of the respective scrapers to a workface to be scraped.

2. The scraping device of claim 1 in which said arms are substantially planar and are made of a resilient material.

3. The scraping device of claim 2, in which the radially extending free edges of said arms are concavely curved, in order to distribute stresses arising in the use of the scraper substantially equally across said arms.

4. The scraping device according to claim 1, in which said arms are comprised of two or more substantially Y-shaped substantially planar members fixed to each other at a central portion thereof.

5. The scraping device of claim 1, in which said scrapers each are of substantially triangular shape, and each edge of said scrapers is outwardly convexly curved.

6. The scraping device of claim 1, in which said scrapers are frictionally restrained by said mounting means to prevent free rotational movement relative to the associated said arm.

* * * * *